US012163303B2

(12) United States Patent
Johnson

(10) Patent No.: US 12,163,303 B2
(45) Date of Patent: Dec. 10, 2024

(54) RAISED FOUNDATION SYSTEM FOR PREFABRICATED REAL PROPERTY STRUCTURE

(71) Applicant: Christopher Clayton Johnson, Cape Coral, FL (US)

(72) Inventor: Christopher Clayton Johnson, Cape Coral, FL (US)

( * ) Notice: Subject to any disclaimer, the term of this patent is extended or adjusted under 35 U.S.C. 154(b) by 0 days.

(21) Appl. No.: 18/394,023

(22) Filed: Dec. 22, 2023

(65) Prior Publication Data

US 2024/0125075 A1 Apr. 18, 2024

Related U.S. Application Data

(60) Provisional application No. 63/455,722, filed on Mar. 30, 2023.

(51) Int. Cl.
*E02D 27/02* (2006.01)
*E04B 1/343* (2006.01)

(52) U.S. Cl.
CPC ..... *E02D 27/02* (2013.01); *E04B 1/34352* (2013.01)

(58) Field of Classification Search
CPC ..... E02D 27/02; E04B 1/34352; E04B 5/14; E04C 2003/026
See application file for complete search history.

(56) References Cited

U.S. PATENT DOCUMENTS 4,064,668 A * 12/1977 Carter ..... E04B 1/34352 248/188.7
4,106,258 A * 8/1978 Lindsay ..... E04B 5/12 52/693
4,546,581 A * 10/1985 Gustafson ..... E02D 27/34 52/262
4,863,189 A * 9/1989 Lindsay ..... B62D 21/02 280/789
4,899,497 A * 2/1990 Madl, Jr. ..... E04B 1/0007 52/126.6
5,152,108 A * 10/1992 Madl, Jr. ..... E02D 27/02 52/DIG. 11

(Continued)

FOREIGN PATENT DOCUMENTS

WO WO-9928572 A1 * 6/1999 ..... E02D 27/02

OTHER PUBLICATIONS

Mobile Home Outfitters, Xi1 Concrete System with 5' Lateral Strut: Tie Down Engineering, Apr. 18, 2023 or earlier, https://mobilehomeoutfitters.com/building-materials/5-dry-set-hardware-kit-for-xi2-concrete-system/.

(Continued)

*Primary Examiner* — Adriana Figueroa
(74) *Attorney, Agent, or Firm* — George F. Wallace

(57) ABSTRACT

A raised foundation system for supporting a prefabricated real property structure having a downwardly facing mounting structure. The system includes a slab having footers; for each footer, a column attached thereto; a plurality of elongated main braces attached to the columns; and a plurality of elongated lateral braces attached to the main braces. At least two of the main braces extend along a plane, and each lateral brace extends the plane or another plane parallel to the plane. The main and lateral braces form an upwardly facing mounting structure configured to attach to the downwardly facing mounting structure.

17 Claims, 6 Drawing Sheets

(56) References Cited

U.S. PATENT DOCUMENTS

| | | | | |
|---|---|---|---|---|
| 5,201,546 | A * | 4/1993 | Lindsay | E04B 5/14 280/789 |
| 5,359,821 | A | 11/1994 | Merriman | |
| 5,488,809 | A * | 2/1996 | Lindsay | E04B 5/14 52/143 |
| 5,697,191 | A | 12/1997 | MacKarvich | |
| 5,862,635 | A | 1/1999 | Linse et al. | |
| 5,992,121 | A * | 11/1999 | Lindsay | E04C 3/16 280/789 |
| 6,094,873 | A * | 8/2000 | Hoffman | E02D 27/01 52/294 |
| 6,345,484 | B1 | 2/2002 | Oliver et al. | |
| 6,748,717 | B2 * | 6/2004 | Sumner, Sr. | E04B 1/34352 52/741.15 |
| 2001/0047634 | A1 * | 12/2001 | Wick | E04B 5/14 280/789 |
| 2002/0170253 | A1 | 11/2002 | MacKarvich | |
| 2017/0260737 | A1 * | 9/2017 | Ota | E04H 1/02 |
| 2017/0328023 | A1 * | 11/2017 | Smith | E04H 12/2238 |
| 2020/0392689 | A1 | 12/2020 | Oliver et al. | |
| 2021/0054587 | A1 | 2/2021 | Reusing | |

OTHER PUBLICATIONS

Today's Homeowner With Danny Lipford, Pier and Beam Foundation: Pros and Cons, cost, and Comparisons, Dec. 31, 2023 or earlier, https://todayshomeowner.com/foundation/guides/pier-and-beam- foundation/.

FEMA, Reasonably Safe from Flooding Requirement for Building on Filled Land, NFIP Technical Bulletin, Mar. 2023, FEMA Media Library, www.fema.gov/multimedia-library.

* cited by examiner

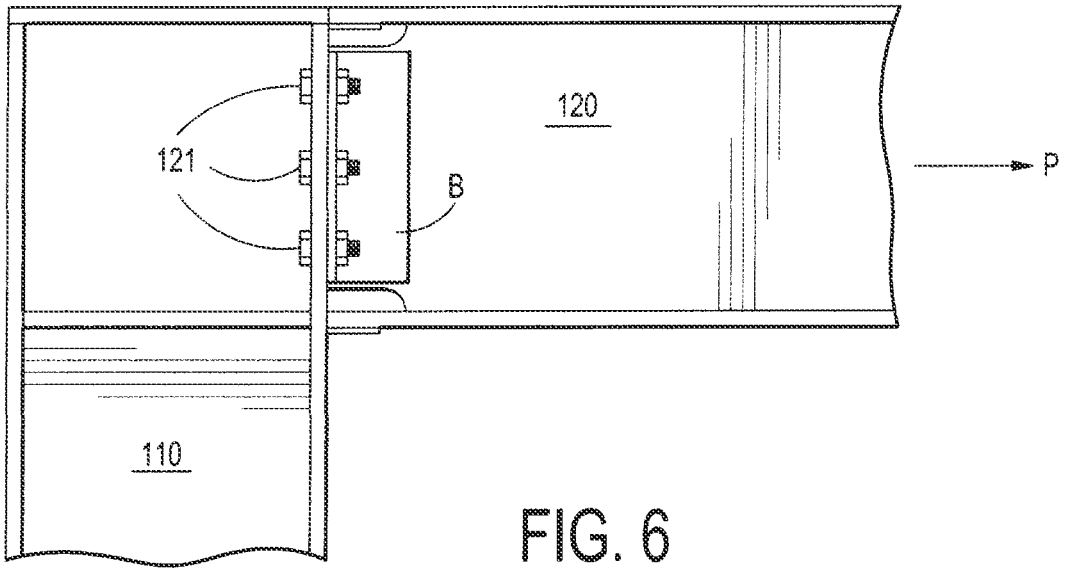
FIG. 6
FIG. 7
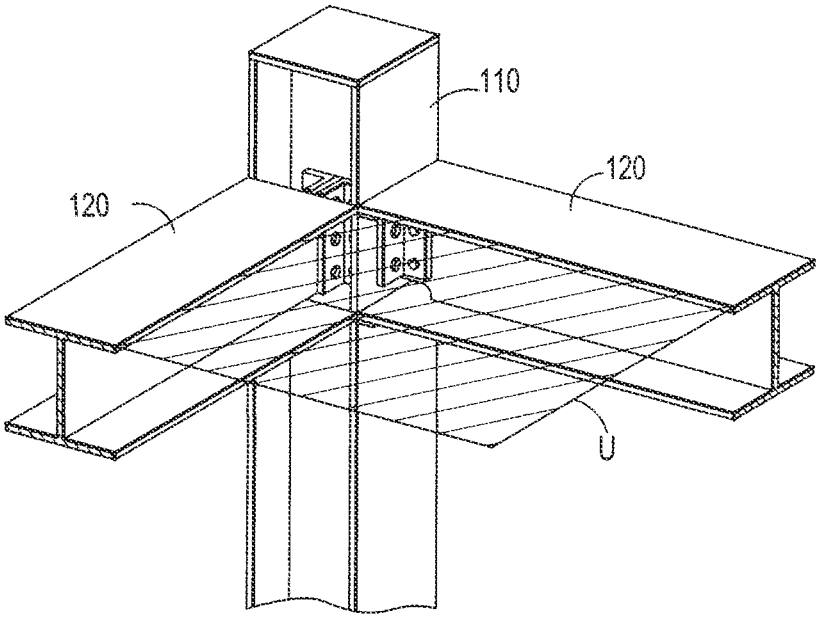

100'

RAISED FOUNDATION SYSTEM FOR PREFABRICATED REAL PROPERTY STRUCTURE

RELATED DOCUMENTS

This application is related to, incorporates by reference in its entirety, and claims the priority benefit of U.S. Provisional Patent Application Ser. No. 63/455,722 entitled Raised Foundation System for Prefabricated Real Property Structure and filed on Mar. 30, 2023 by Christopher Clayton Johnson.

BACKGROUND OF THE INVENTION

Prefabricated property structures can provide a convenient and cost-effective means for providing residential, commercial, and other use space. Such structures can be delivered in a generally finished state for immediate use. Further, such structures can be provided with a downwardly facing mounting structure to allow such property structures to be placed on cinder blocks or a flat surface. However, such structures can be particularly susceptible to damage arising from flood waters, not only from typical water damage due to water intrusion, but also from catastrophic damage arising from lateral movement of such structures due to buoyancy forces produced thereby.

SUMMARY OF THE INVENTION

The present invention provides a raised foundation system that can support a prefabricated real property structure having a downwardly facing mounting structure configured to directly rest on a foundation. Prefabricated real property structures can include, for example and not in limitation, mobile homes and modular buildings, including those formed from shipping containers. While prefabricated real property structures can provide efficient utility, such can also be susceptible to heightened damage arising from flood waters.

In an exemplary embodiment of the present invention, a raised foundation system can include a slab having a plurality of footers formed therein; for each footer, a column can be attached thereto; a plurality of elongated main braces, and each main brace can have first and second main brace ends connecting one of said columns to another of said columns and at least two of said braces can extend along a plane; a plurality of lateral braces, and each lateral brace can have a first end attached to one of the of main braces and a second end attached to another of the main braces, and each lateral brace can extend along one of the plane and another plane parallel to the plane.

In an exemplary aspect of the invention, such columns and main braces can form an upwardly facing mounting structure configured to securely engage a downwardly facing structure of a prefabricated real property structure.

In another exemplary embodiment of the present invention, a raised foundation system can further include at least one auxiliary brace.

In another exemplary aspect, at least one of said auxiliary braces can have first and second auxiliary brace ends; the first auxiliary brace end can be configured to attach to at least one lateral brace, the second auxiliary brace end can be configured to attach to one of another lateral brace and a main brace; and the auxiliary brace can extend diagonally from one of the lateral braces.

In a further exemplary aspect, at least one said auxiliary braces can extend along one of the plane and the other plane parallel to the plane.

In a further exemplary aspect, said plurality of main braces can form at least one closed circuit.

In yet another exemplary aspect, said plurality of main braces can form a perimeter closed circuit.

In still yet another exemplary aspect, first and second columns can be provided with different lengths.

In a further exemplary aspect, each column can include a first column end secured to a respective footer, and a second column end configured to attach to the downwardly facing mounting structure.

In another exemplary aspect, at least one first column end can be removably attached to a respective footer.

In yet another exemplary aspect, the upwardly facing structure can be removably attached to a downwardly facing mounting structure.

In still another exemplary aspect, at least two main braces can extend along another plane parallel to the plane of at least one of the other main braces.

These and other exemplary aspects and embodiments of the present invention are further described herein.

BRIEF DESCRIPTION OF THE DRAWINGS

FIG. 6 illustrates an elevation-view of an exemplary connection of a main brace to a column.

FIG. 7 illustrates an isometric-view of an exemplary connection of two exemplary main braces extending along a plane and connected to a column.

DETAILED DESCRIPTION

Figure 1A:
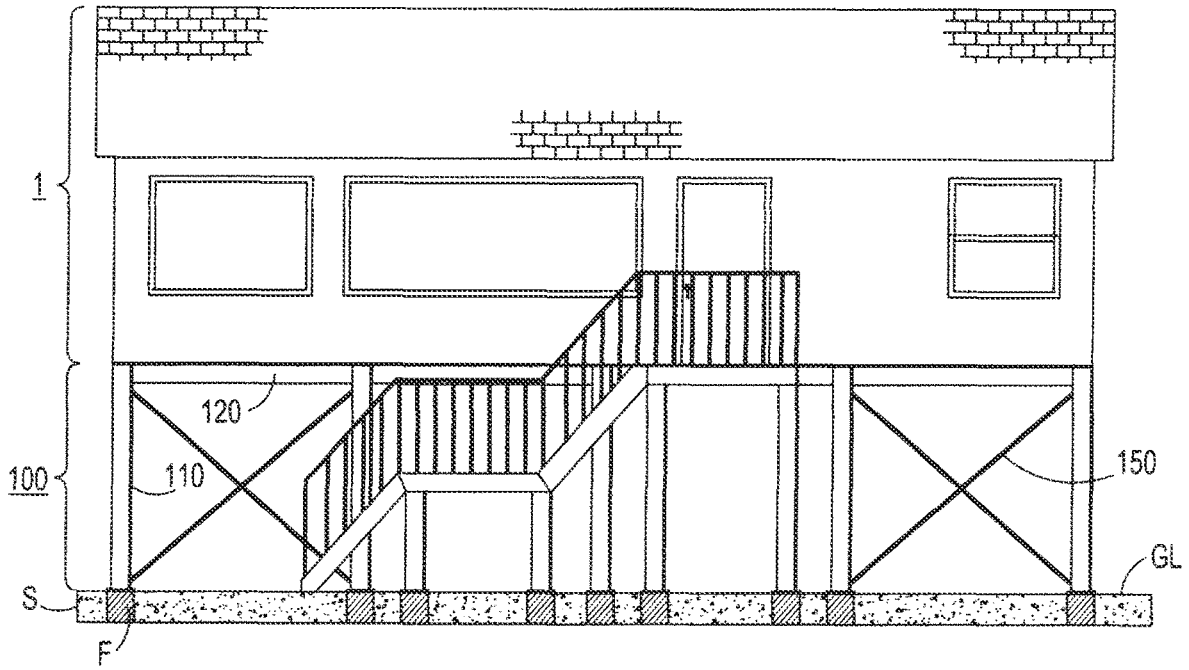
FIG. 1A illustrates an elevation-view of an exemplary raised foundation system supporting a prefabricated real property structure in a raised configuration.

It is an object of the present invention to provide a raised foundation system for a prefabricated real property structure.

It is another object of the present invention to provide a raised foundation system in combination with a prefabricated real property structure.

These and other objects are expressly and apparently provided via the illustrative embodiments described herein.

It should be noted that this disclosure includes a plurality of embodiments, each having a plurality of elements and/or aspects, and such elements and/or aspects need not necessarily be interpreted as being conjunctively required by one or more embodiments of the present invention. Rather, all combinations of all elements and/or aspects described herein can enable a separate embodiment of the present invention, which may be claimed with particularity in one or more future filed Non-Provisional Patent Applications.

Moreover, any particular structure, arrangement, and/or configuration disclosed herein, whether expressly or implicitly, are to be construed strictly as illustrative and enabling, and not necessarily limiting. Therefore, it is expressly set forth that such structures, arrangements, and configurations, independently or in any combination of one of more thereof, are merely illustratively representative of one or more elements and/or aspects of one or more embodiments of the present invention and are not to be construed as necessary in a strict sense.

Further, to the extent the same element or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention. Exemplary functional utility provided by a raised foundation system disclosed herein includes raising a prefabricated real property structure to a desired height above the ground, so as to protect the structure from flood water, insects, and animals, for example and not in limitation, as well as providing a raised foundation system that can be removable in whole or in part from a slab/footers and/or a prefabricated real property structure.

According to the present invention, a raised foundation system can be formed from one or more materials or combinations of materials, such as one or more of concrete, plastic, rubber, wood, metal, a crystalline material, or any other man-made or naturally occurring material, for example and not in limitation, insofar as the same is functionally consistent with the invention as described. Further, a raised foundation system can be manufactured in any one or more functionally compatible manners, such as manufactured onsite, premanufactured offsite, with welded connections, with mechanical attachment structures, with embedded connections, or any combination thereof, for example and not in limitation.

Figure 1B:
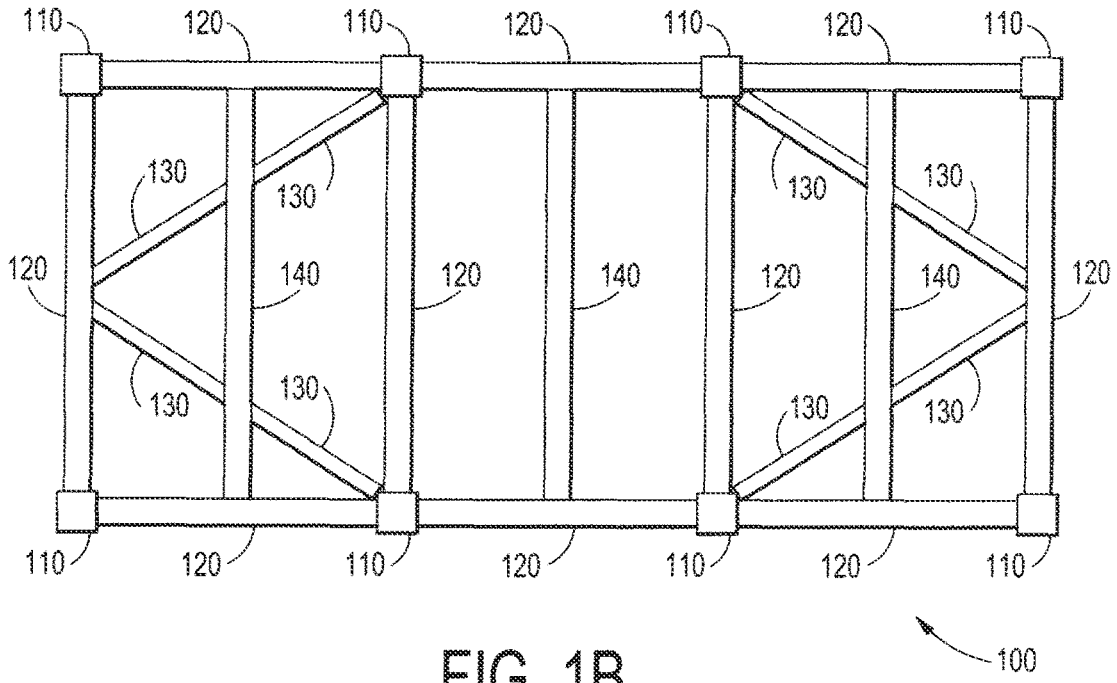
FIG. 1B illustrates a top-view of an exemplary arrangement of main and lateral braces, along with optional auxiliary braces.

FIGS. 1A and 1B illustrate an exemplary embodiment of the present invention, in which a raised foundation system 100 for a prefabricated real property structure 1 having a downwardly facing mounting structure can include a slab S having a plurality of footers F formed therein; for each footer, a column 110 secured thereto; a plurality of elongated main braces 120, with each main brace connecting one of said columns to another of said columns and can extend along a plane; and a plurality of lateral braces 140, with each lateral brace having a first end attached to one of the main braces and a second end attached to one of another of the main braces and one of the columns, and each lateral brace can extend from the one of the main braces and along one of the plane and another plane parallel to the plane; and the main and lateral braces form an upwardly facing mounting structure configured to attach to the downwardly facing mounting structure and to support the prefabricated real property structure.

Notably, prefabricated real property structures can include, for example and not in limitation, mobile homes and modular buildings, including those formed from shipping containers. Further notably, a raised foundation system can include an upwardly facing mounting structure configured to attach to a downwardly facing mounting structure of a prefabricated real property structure having any desirable shape or configuration thereof, insofar as functionally compatible with the present invention. With columns 110, main braces 120, lateral braces 140, and optionally, auxiliary braces 130, positioned and connected, raised foundation system 100 can be constructed and prepared for strategic placement thereon of a prefabricated real property structure, which can be effectuated via a crane, for example and not in limitation. Attachment of such real property structure to system 100 can be effectuated via any desired means and utilize any desired one or more attachment structures, such as by welding, bolt-nut combinations, etc. for example and not in limitation. Alternatively, the present invention can additionally include the prefabricated real property structure, in which case, the combination can be provided as a complete package.

As further illustratively shown in FIG. 1A, the present invention can be embodied in a raised foundation system 100 for a prefabricated real property structure 1, and can raise the real property structure above a ground level GL.

Figure 2:
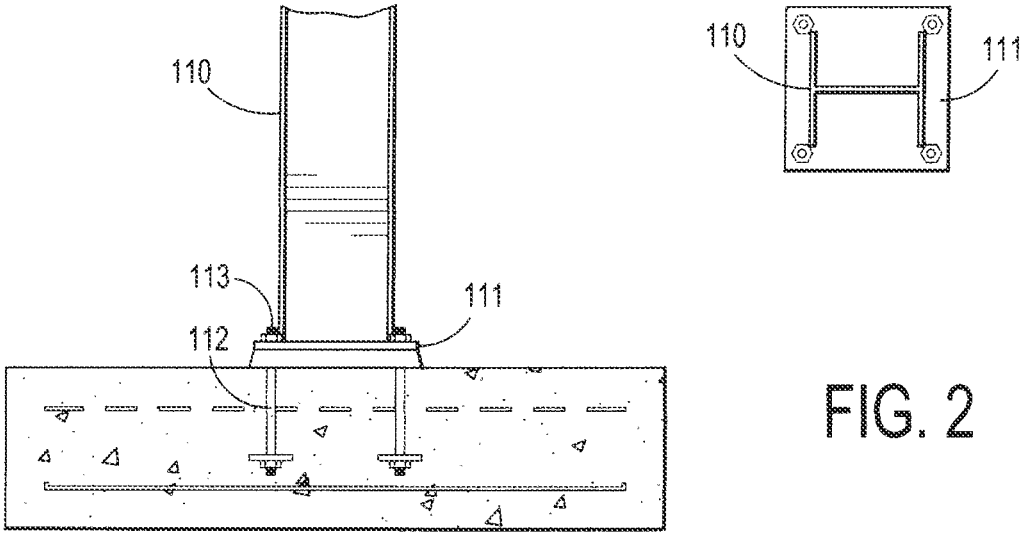
FIG. 2 illustrates an elevation-view and a top-view of an exemplary footer configuration with an exemplary bracket.
Figure 3:
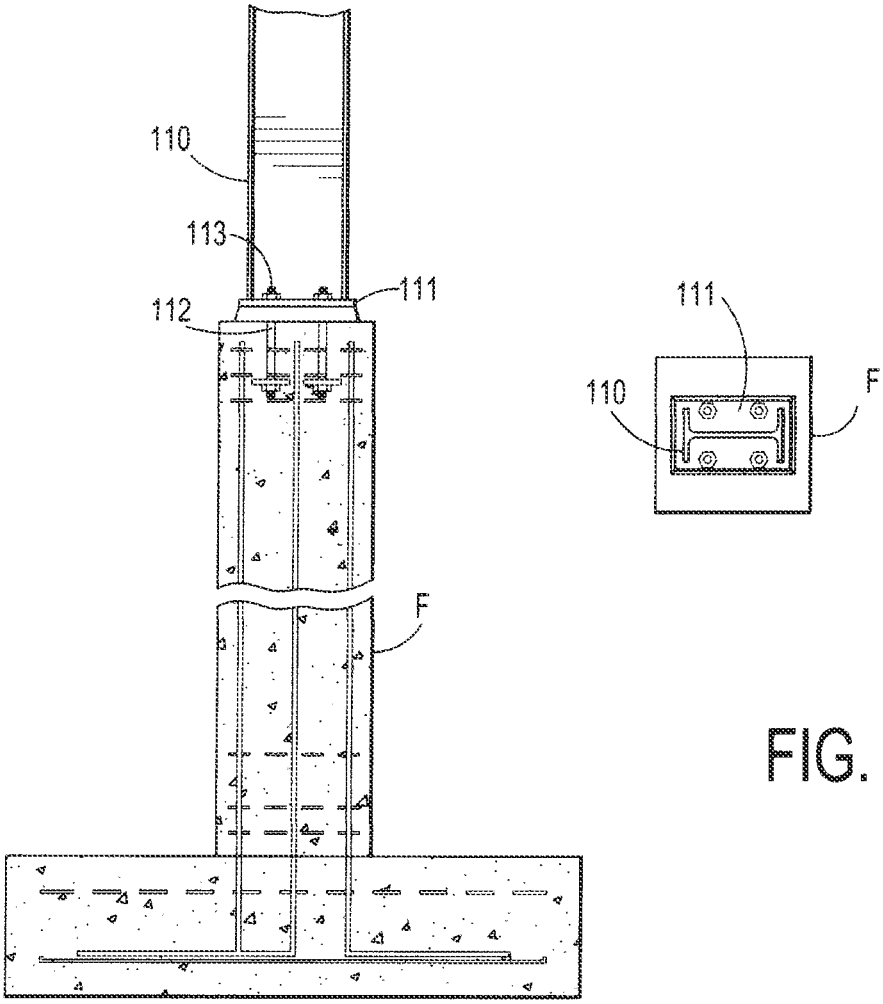
FIG. 3 illustrates an elevation-view and a top-view of another exemplary footer configuration with an exemplary bracket.

In an exemplary aspect, as illustrated in FIGS. 1A, 2, and 3, a raised foundation system 100 can include a slab S having a plurality of footers F formed therein and columns 110 attached thereto. Notably, footers F can be precast or formed in place, with slab S being poured therearound, for example and not in limitation.

As further illustrated in FIGS. 2 and 3, footers F can be configured to accommodate different scour depths, which can be dictated by the size of columns 110. Notably, brackets 111 can be configured to accommodate the particular shape and/or size of the columns to facilitate a secure attachment of columns to footers F. As still further illustrated, footers F can be optionally provided with anchor bolts 112 formed therein and extending therefrom, such that a respective bracket 111 can be positioned between a footer and column 110 and nuts 113 can be utilized to effectuate a secure connection of a column to a footer, for example and not in limitation. Further notably, a secure connection of a column to a footer can be effectuated via any desired configuration and provided with any connection type insofar as the same is functionally compatible with the present invention.

In another exemplary aspect, columns 110 can be positioned in any desired arrangement, and be of any desired length or lengths, insofar as the same is functionally consistent with the present invention. In an exemplary aspect, as illustrated in FIGS. 1A and 1B, columns 110 can be positioned and spaced to form a perimeter that can compatibly coincide with a prefabricated real property structure. In yet another exemplary aspect, two or more columns 110 can be provided with different lengths to accommodate uneven ground surfaces, such as when positioning a real property structure on a hill, for example and not in limitation.

As further illustrated in FIG. 1B, main braces 120, lateral braces 140, and optional auxiliary braces 130 can form an upwardly facing mounting structure, in whole or in part, that can be configured to compatibly engage a downwardly facing mounting structure (not shown) of a prefabricated real property structure. As illustrated in FIG. 1B, main braces 120 can connect columns 110 to each other, lateral braces 140 can connect main braces 120 to at least one of another main brace and a column, and optional auxiliary braces 130 can connect a lateral brace to one of another lateral brace and a main brace, any of which can assist in providing rigidity and strength to system 100. Notably, while lateral braces 140 are illustratively shown as being connected to main braces 120 in a perpendicular orientation relative to such braces; it should be noted that lateral braces 140, main braces 120, and optional auxiliary braces 130 can be respectively attached so as to be positioned in any desired angle insofar as the same is functionally compatible with the present invention.

Figure 4:
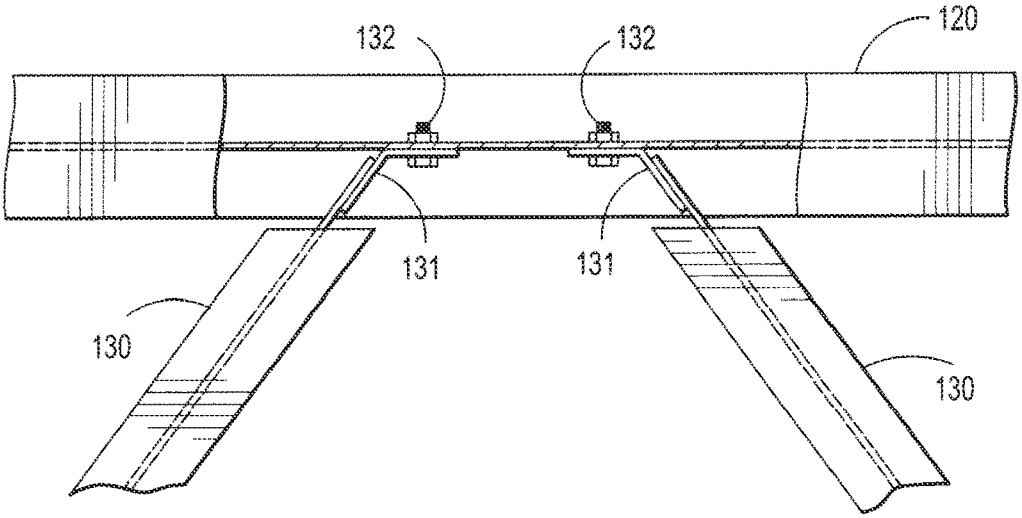
FIG. 4 illustrates a top-view of an exemplary optional auxiliary braces connected to a main brace.
Figure 5:
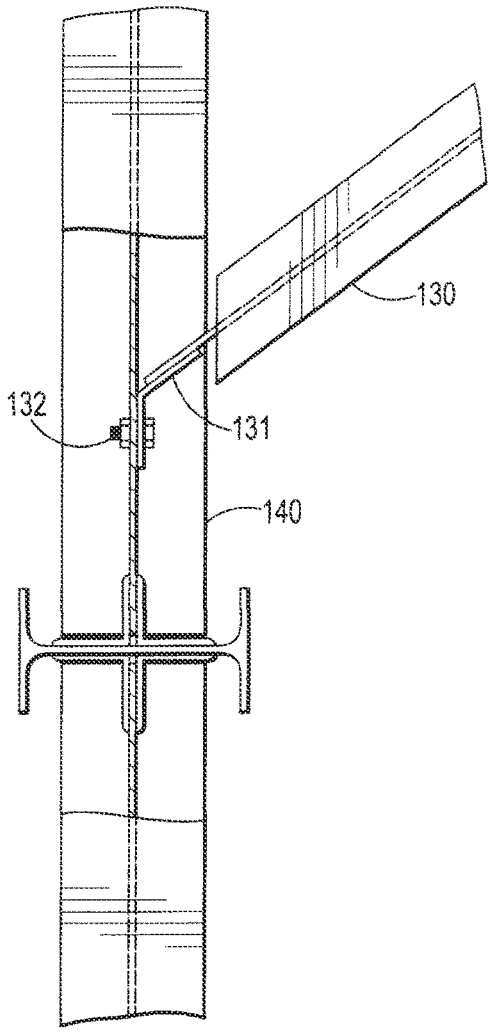
FIG. 5 illustrates a top-view of an exemplary optional auxiliary brace connection to a lateral brace.

FIG. 4 illustrates exemplary optional auxiliary braces 130 connected to a mid-span of main brace 120, while FIG. 5 illustrates an exemplary optional auxiliary brace 130 connected to a lateral brace 140. Such connections can be effectuated via attachment structures 131 and 132, which are illustratively shown as bracket plates and bolt-nut combinations, respectively, which can be welded together.

FIG. 6 illustrates an exemplary connection of a main brace 120 to a column 110, with utilization of bolt-nut combinations 121 and optional bracket B to effectuate the connection. In an exemplary aspect, main brace 120 can extend along a plane P, as additionally illustrated in FIG. 7. Notably, main brace 120 can connect at any point along column 110, such that the end of the column can extend above main brace 120 as illustrated in FIG. 7, or the end of column 110 can coincide with the top of main brace 120 as illustrated in FIG. 6, for example and not in limitation. In another exemplary aspect, the end of column 110 can be configured to connect, directly or indirectly, to the downwardly facing mounting structure. In yet another exemplary aspect, when connected to columns 110, main braces 120 can form one or more closed circuits, as further illustrated in FIG. 1B.

Figure 8:
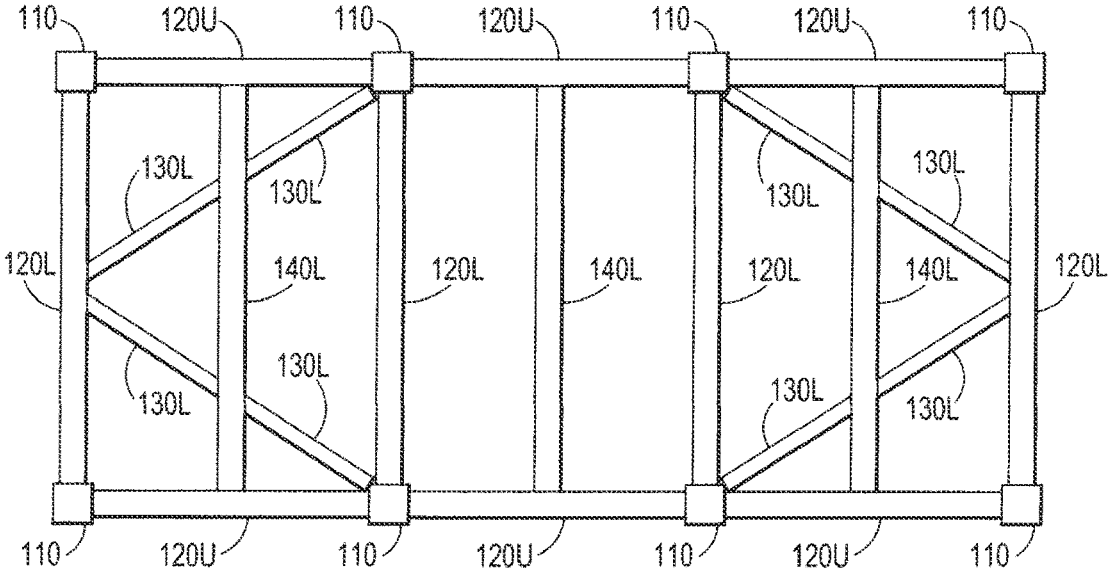
FIG. 8 illustrates a top-view of an exemplary arrangement of main and lateral braces and optional auxiliary braces on different planes.
Figure 9:
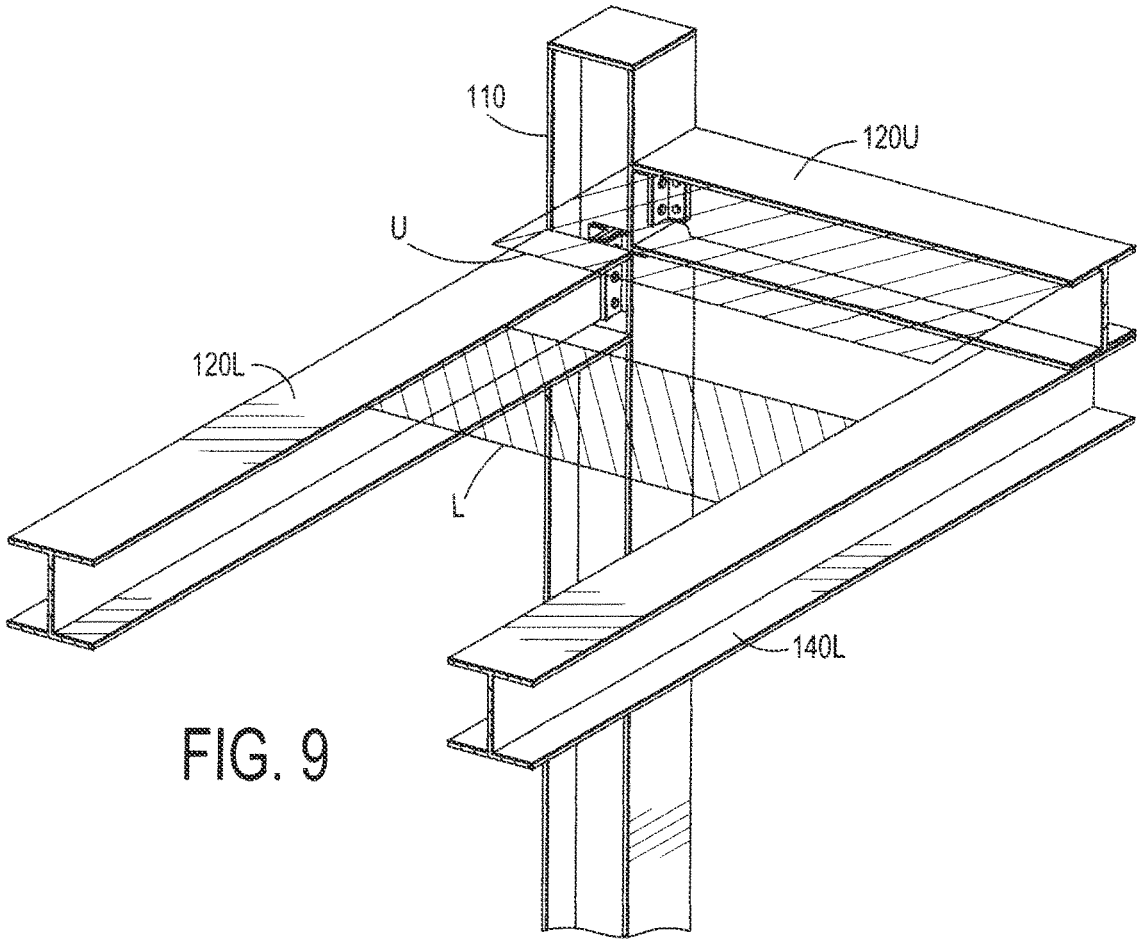
FIG. 9 illustrates an isometric-view of an exemplary arrangement of main and lateral braces on different planes.

FIGS. 8 and 9 illustrate exemplary main braces 120L, lateral braces 140L, and optional auxiliary braces 130L extending along lower plane L, and main braces 120U extending along upper plane U. While illustratively shown as extending along two parallel planes, any combination of main braces 120U, 120L, lateral braces 140L and optional auxiliary braces 130L can extend along any number of parallel planes desired insofar as the same is functionally compatible with the present invention. Notably, any such arrangement of main braces 120U 120L, lateral braces 140L, and optional auxiliary braces 130L, with respect to one or more parallel planes, can form an upwardly facing mounting structure configuration desired insofar as the same is functionally compatible with the present invention.

Figure 10:
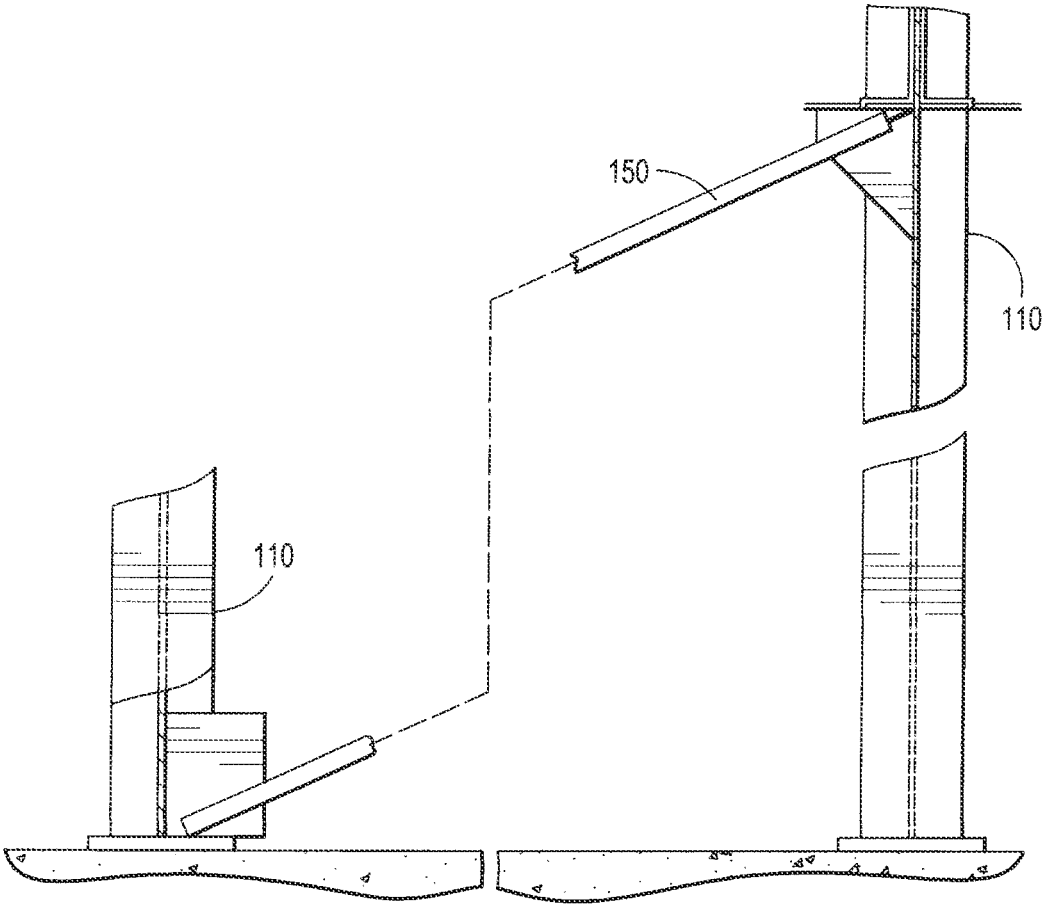
FIG. 10 illustrates a broken-elevation-view of an exemplary optional cross brace connection between columns.

FIG. 10 illustrates an exemplary optional cross brace 150 connected to columns 110 at different points. Notably, cross brace 150 can be provided as a single brace as illustrated in FIG. 10, or as multiple braces, as illustrated in FIG. 1A. Further, cross brace 150 can be oriented in any desired angle insofar as functionally compatible with the present invention.

It should be noted that columns 110, main braces 120, lateral braces 140, optional auxiliary braces 130, and optional cross braces 150 can be formed of any desired material or combination of materials, and further, can be provided with any desired shape or combination of shapes, which collectively provide sufficient overall strength and stability to structurally support a real property structure placed and secured thereon. In exemplary embodiments, such elements can be provided as metallic I-Beams, for example and not limitation. Further, such elements can be provided with any desired lengths, such as 4 feet, 6 feet, 8 feet, etc. so as to effectively raise a subsequently attached real estate structure a desired level above ground level GL.

It should be noted that one or more exemplary attachments and/or connections of elements of the present invention have been illustratively shown to be effectuated with bolt-nut combinations, however, such attachments and/or connections are not limited thereto. For example and not in limitation, such attachments and/or connections can be effectuated by any other functionally compatible manner and include any one more structures desired, such as via welding, clamps, sleeves, etc.

It will be apparent to one of ordinary skill in the art that the manner of making and using the claimed invention has been adequately disclosed in the above-written and attached description of the exemplary embodiments and aspects of the present invention.

It should be understood, however, that the invention is not necessarily limited to the specific embodiments, aspects, arrangements, and components shown and described above, but may be susceptible to numerous variations within the scope of the invention. For example, some elements illustratively shown herein have been presented as having linear shapes, but may be provided with one or more linear and/or non-linear shapes, including curvilinear shapes.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents apparent to one of ordinary skill in the art.

Therefore, I claim:

1. A raised foundation system for supporting a prefabricated real property structure having a downwardly facing mounting structure configured to be moved and directly placed on said raised foundation system, said system comprising:

a slab having a plurality of footers formed therein;

for each footer, a column attached thereto;

a plurality of elongated main braces, with each main brace having a first main brace end attached to one of said columns and a second main brace end attached to another of said columns; and a plurality of elongated lateral braces, with each lateral brace having a first lateral brace end attached to one of said main braces and a second lateral brace end attached to another of said main braces;

wherein at least two of said main braces extend along a plane, each of said lateral braces extend along one of the plane and another plane parallel to the plane, at least two other of said main braces extend along the other plane parallel to the plane, and said main and lateral braces form an upwardly facing mounting structure configured to attach to the downwardly facing mounting structure and to support the prefabricated real property structure.

2. The system of claim 1, further comprising at least one auxiliary brace having a first auxiliary brace end attached to one of said lateral braces and a second auxiliary brace end attached to one of another of said lateral braces and a respective main brace of said plurality of main braces, and said at least one auxiliary brace extends diagonally from the one of said lateral braces.

3. The system of claim 2, wherein said at least one auxiliary brace extends along one of the plane and the other plane.

4. The system of claim 1, wherein at least two of said columns have different lengths.

5. The system of claim 1, wherein each column is removably attached to a respective footer.

6. The system of claim 1, wherein the upwardly facing mounting structure is removably attached to the downwardly facing mounting structure.

7. The system of claim 2, wherein said at least one auxiliary brace extends along one of the plane and the other plane.

8. The system of claim 1, wherein said plurality of main braces form at least one closed circuit.

9. The system of claim 1, wherein at least two of said columns have different lengths.

10. The system of claim 1, wherein each column is removably attached to a respective footer.

11. The system of claim 1, wherein at least two other of said main braces extend along the plane.

12. The system of claim 11, further comprising at least one auxiliary brace having a first auxiliary brace end attached to one of said lateral braces and a second auxiliary brace end attached to one of another of said lateral braces and a respective main brace of said plurality of main braces, and said at least one auxiliary brace extends diagonally from the one of said lateral braces.

13. The system of claim 12, wherein said at least one auxiliary brace extends along one of the plane and the other plane.

14. The system of claim 11, wherein said plurality of main braces form at least one closed circuit.

15. The system of claim 11, wherein at least two of said columns have different lengths.

16. The system of claim 11, wherein each column is removably attached to a respective footer.

17. The system of claim 11, wherein the upwardly facing mounting structure is removably attached to the downwardly facing mounting structure.

* * * * *